United States Patent [19]

Raggiotti

[11] Patent Number: 4,460,146

[45] Date of Patent: Jul. 17, 1984

[54] PORTABLE READING DESK

[75] Inventor: Guglielmo Raggiotti, Perugia, Italy

[73] Assignee: Interstudio Design s.a.s., Perugia, Italy

[21] Appl. No.: 413,431

[22] Filed: Aug. 31, 1982

[51] Int. Cl.[3] ..... A47G 1/24

[52] U.S. Cl. ..... 248/456; 248/460

[58] Field of Search ..... 248/456, 457, 459, 460, 248/463, 465; 40/142.1, 120

[56] References Cited

U.S. PATENT DOCUMENTS

| | | | |
|---|---|---|---|
| 1,053,112 | 2/1913 | Scott | 248/456 |
| 1,180,057 | 4/1916 | McNamara | 248/456 |
| 1,965,794 | 7/1934 | Davidson . | |
| 2,165,255 | 7/1939 | Hamilton . | |
| 2,224,530 | 12/1940 | Weinstein . | |
| 3,311,202 | 3/1967 | Schell et al. . | |
| 3,460,795 | 8/1969 | Dahlin | 248/456 X |
| 3,718,308 | 2/1973 | Hainault | 248/460 |
| 3,773,154 | 11/1973 | Mitchell . | |

FOREIGN PATENT DOCUMENTS

| | | | |
|---|---|---|---|
| 662591 | 5/1963 | Canada | 248/460 |

*Primary Examiner*—Ramon S. Britts
*Assistant Examiner*—Sarah A. Lechok
*Attorney, Agent, or Firm*—John J. Byrne; Bradford E. Kile; Kevin M. O'Brien

[57] ABSTRACT

Disclosed is a portable reading desk formed from a single piece of thin, flat, generally rectangular stock. The stock is cut and creased into three portions which can be folded either flat for travel or into a three dimensional configuration in which the desk will support a book or the like in position to be read.

5 Claims, 5 Drawing Figures

PORTABLE READING DESK

FIELD OF THE INVENTION

This invention relates to a reading desk or stand used to support a book or the like in position to be read. In particular, it relates to such a reading desk which can be molded or die-stamped in one piece from thin, flat stock and folded either flat for travel or into a three-dimensional configuration in which it will support a book or the like in position to be read.

BACKGROUND OF THE INVENTION

Reading desks or stands used to support a book or the like in position to be read are, of course, well known per se. Known reading desks or stands are often quite elaborate. While they are often portable in the sense that they are small enough to be picked up and carried, they are not collapsible into a portable configuration in which they consume markedly less space than in their use configuration.

A few reading desks are known which are collapsible into a portable configuration. Such reading desks are shown, for example, in U.S. Pat. No. 2,165,255, issued July 26, 1937 to Hamilton and U.S. Pat. No. 2,224,530, issued Apr. 19, 1940, to Weinstein. Such reading desks, however, are relatively elaborate when compared with the instant device.

OBJECTS OF THE INVENTION

It is, therefore, a general object of this invention to provide a reading desk which is collapsible into a portable configuration, but which is simpler to manufacture than prior-art articles of the same general character.

It is a particular object of this invention to provide such a reading desk which can be molded or die-stamped in one piece from thin, flat stock.

It is a further object of this invention to provide a reading desk which can also serve as a fixed or detachable panel in an attache case.

Other features and advantages of the invention will be set forth in, or apparent from, the detailed description of the presently preferred embodiment thereof given hereinafter.

SUMMARY OF THE INVENTION

A portable reading desk according to the present invention is formed from a single piece of thin, flat, generally rectangular stock. The stock is cut and creased into three principal portions which can be folded either flat for travel or into a three-dimensional configuration in which the desk will support a book or the like in position to be read.

DETAILED DESCRIPTION OF THE PRESENTLY PREFERRED EMBODIMENT

Figure 1:
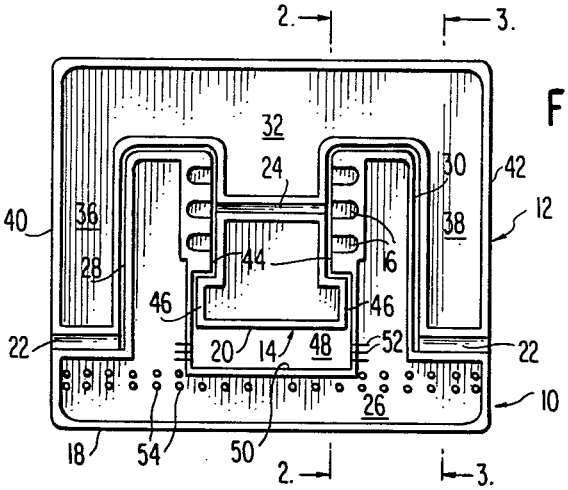
FIG. 1 is a plan view of the preferred embodiment of the desk in its collapsed condition.
Figure 5:
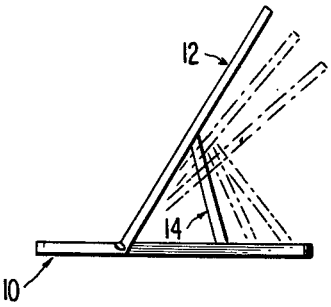
FIG. 5 is a schematic side view of the preferred embodiment of the desk illustrating its adjustability.
Figure 4:
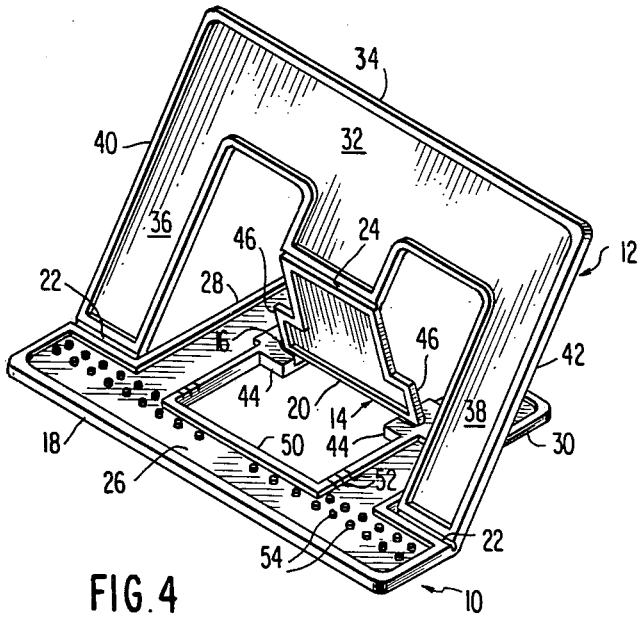
FIG. 4 is a perspective view of the preferred embodiment of the desk in its use condition.
Figure 2:
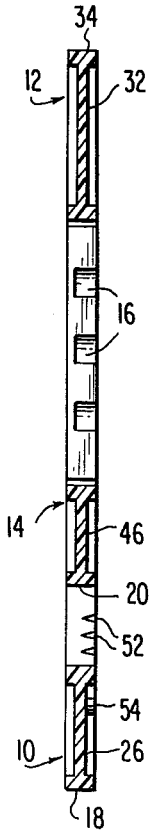
FIG. 2 is a view along the line 2—2 in FIG. 1.
Figure 3:
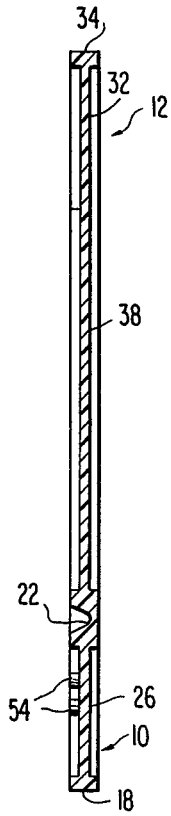
FIG. 3 is a view along the line 3—3 in FIG. 1.

Referring now to the drawings where like numerals refer to like parts, 10 refers to a portable reading desk shown formed from a single piece of thin, flat, generally rectangular stock. The desk can be manufactured in a single stamping or molding operation.

The portable reading desk shown in the drawings is composed of a first portion 10 which serves as a horizontal support for the desk when it is in use, a second portion 12 which serves, when the desk is in use, as an angulated support for an object, such as a book, to be read, and a third portion 14 which serves as a prop or strut for the second portion 12 when the desk is in use. The first portion 10 has a plurality of detent notches 16 formed therein spaced from one another at a uniform distance from the front edge 18 of the first portion 10. The front edge 20 of the third portion 14 is sized and shaped to fit releasably into the detent notches 16 when the desk is in use. The second portion 12 is connected to the first portion 10 by a fold or crease line 22 which is parallel to the front edge 18 of the first portion 10, and the third portion 14 is connected to the second portion 12 by a fold or crease line 24 which also is parallel to the front edge 18 of the first portion 10.

The first portion 10 is composed of a first member 26 which is generally rectangular in shape and which includes the front edge 18 and second and third members 28 and 30 each of which is generally rectangular in shape and perpendicular to front edge 18 in the same plane, and each of which extends rearwardly and perpendicularly from the first member 32 which is generally rectangular in shape and which includes the rear edge 34 of the desk and second and third members 36 and 38 each of which is generally rectangular in shape and perpendicular in the same plane to near edge 34 and extends forwardly from it toward front end 18, and each of which extends perpendicularly from the first member 32. The third portion 14 is also generally rectangular in shape and extends at an oblique angle from the first member 32 of the second portion 12. The second member 36 of the second portion 12 includes the left edge 40 of the desk, and the third member 38 of the second portion includes the right edge 42 of the desk. The second member 28 of the first portion 10 is adjacent and parallel to the second member 36 of the second portion 12, and the third member 30 of the first portion 10 is adjacent and parallel to the third member 38 of the second portion 12. Finally, the third portion 14 lies between and is parallel to the second and third members 28 and 30 of the first portion 10.

The second and third members 28 and 30 of the first portion 10 have ears 44 which extend towards each other and which are spaced from the first member 26 of the first portion 10. Correspondingly, the third portion 14 has ears 46 which extend outwardly from its sides and which are spaced from the first member 32 of the second portion 12. The ears 44 contain the detent notches 16, and the ears 46 are sized and shaped to fit releasably into the detent notches 16 when the desk is folded into its use position.

A void 48 is left between the front edge 20 of the third portion 14 and the rear edge 50 of the first member 26 of the first portion 10. The void 48 is formed to serve as a handle for carrying the desk when it is in the flat condition. The edge 50 acts as an abutment against which the lower end of a book spine rests.

A plurality of grooves 52 are provided in the second and third members 28, 30 of the first portion 10 at uniform intervals from the front edge 18 of the desk. The grooves 52 serve to receive and releasably hold the edges of an object, such as a book, whose spine abuts against edge 50. Similarly, a plurality of protrusions 54 are provided on the first member 26 of the first portion 10 to deter sliding movement of an object, such as a book, supported on the desk.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiments.

I claim:

1. A portable and foldable desk having an erected and a collapsed position and formed from a single thin, flat generally rectangular piece, said piece comprising:

(a) a first portion which serves as a horizontal support for the desk when the desk is in use having a front edge and having a plurality of detent notches spaced from one another at varying distances from said front edge;

(b) a second portion which serves as an angulated support for an object to be read when the desk is in use and is connected to said first portion by a fold line which is parallel to the front edge of said first portion; and (c) a third portion which serves as a prop for said second portion when the desk is in use and which is connected to said second portion by a fold line which is parallel to the front edge of said first portion, said third portion being sized and shaped to fit reasonably into said detent notches on said first portion, wherein said first, second and third portions of said piece are foldable into a flat configuration when said piece is converted to said collapsed position, a void being defined between said first and third portions in said collapsed position serving as a handle means.

2. A portable reading desk as recited in claim 1 wherein:

(a) said first portion comprises:

(i) a first member which is generally rectangular in shape and which includes the front edge of the piece and (ii) second and third members each of which is generally rectangular in shape and each of which extends rearwardly and perpendicularly and in the same plane from said front edge from said first member of said first portion, said second and third members of said first portion being spaced from one another;

(b) said second portion comprises:

(i) a first member which is generally rectangular in shape and which includes the rear edge of the piece and (ii) second and third members, each of which is generally rectangular in shape and each of which extends perpendicularly and forwardly in the same plane from said first member of said second portion, said second and third members of said second portion being spaced from one another and lying outside said second and third members of said first portion when the desk is folded flat; and (c) said third portion is generally rectangular in shape and extends at an oblique angle from the first member of said second portion and lies between the second and third members of said first portion when the desk is folded flat.

3. A portable reading desk as recited in claim 2 wherein:

(a) said second and third members of said first portion have ears which extend towards each other, said ears being spaced from said first member of said first portion and containing said detent notches, and (b) said third portion has ears which extend outwardly from the sides thereof, said ears being spaced from said first members of said second portion and being sized and shaped to fit releasably into said detent notches.

4. A portable reading desk as recited in claim 1 wherein groves are provides in said first portion to receive and releasably hold the edges of an object supported on the desk.

5. A portable reading desk as recited in claim 1 wherein protrusions are provided on said first portion to deter the sliding movement of an object supported on the desk.

* * * * *